US006674985B2

(12) United States Patent
Azami

(10) Patent No.: US 6,674,985 B2
(45) Date of Patent: Jan. 6, 2004

(54) IMAGE FORMING APPARATUS

(75) Inventor: Akira Azami, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 8 days.

(21) Appl. No.: 10/159,998

(22) Filed: Jun. 4, 2002

(65) Prior Publication Data

US 2002/0197084 A1 Dec. 26, 2002

(30) Foreign Application Priority Data

Jun. 4, 2001 (JP) ..... 2001-168732
May 9, 2002 (JP) ..... 2002-133811

(51) Int. Cl.[7] ..... G03G 15/08

(52) U.S. Cl. ..... 399/253; 399/252; 430/109.1; 430/110.4; 430/111.4

(58) Field of Search ..... 399/252, 253, 399/270, 343, 358; 430/109.1, 110.1, 110.4, 111.4

(56) References Cited

U.S. PATENT DOCUMENTS 4,994,340 A * 2/1991 Yamazaki et al. .... 430/111.4 X
5,559,593 A * 9/1996 Yoshinaga et al. ..... 399/343
5,565,295 A * 10/1996 Tavernier et al. ..... 430/110.4 X
5,581,336 A * 12/1996 Matsuzaki et al. ..... 399/270
6,226,475 B1 5/2001 Kabumoto et al. ..... 399/107
6,259,866 B1 7/2001 Kabumoto et al. ..... 399/1
6,337,957 B1 1/2002 Tamaki et al. ..... 399/29
6,389,249 B2 5/2002 Kabumoto et al. ..... 399/107
6,396,410 B1 5/2002 Kabumoto et al. .... 340/815.65

FOREIGN PATENT DOCUMENTS

| | | | |
|---|---|---|---|
| JP | 7-248645 | * | 9/1995 |
| JP | 07-295283 | | 11/1995 |
| JP | 8-76436 | * | 3/1996 |
| JP | 8-146668 | * | 6/1996 |
| JP | 2000-39740 | | 2/2000 |
| JP | 2000-172005 | | 6/2000 |
| JP | 2000-181128 | | 6/2000 |
| JP | 2000-194161 | | 7/2000 |

* cited by examiner

*Primary Examiner*—Fred L. Braun
(74) *Attorney, Agent, or Firm*—Oblon, Spivak, McClelland, Maier & Neustadt, P.C.

(57) ABSTRACT

In accordance with the present invention, in an image forming apparatus of the type developing a latent image formed on an image carrier, which moves at a linear velocity of 400 mm/sec or above, with a developer containing toner grains having a volume mean grain size of 5 μm to 10 μm and 60 number percent to 80 number percent of which has a grain size of 5 μm or below, the developer contains carrier grains having a weight mean grain size of 65 μm or below. When use is made of toner with a small grain size, the apparatus successfully obviates background contamination, toner scattering and sleeve contamination without regard to operation speed or environmental conditions.

12 Claims, 10 Drawing Sheets

FIG. 8

| TONER RECYCLING | NOT EFFECTED | EFFECTED | ↓ | ↓ |
|---|---|---|---|---|
| CARRIER GRAIN SIZE (μm) | 50 | 50 | 65 | 80 |
| TONER SCATTERING | 5 | 4 | 3.5 | 3 |
| BACKGROUND CONTAMINATION | 4.5 | 4 | 3.75 | 3 |

FIG. 9

| TONER RECYCLING | NOT EFFECTED | EFFECTED | ← | ← |
|---|---|---|---|---|
| SILICA/TITANIUM | 0.9/0.4 | 0.9/0.4 | 0.9/0 | 0.45/0 |
| TONER SCATTERING | 4.5 | 4 | 3.5 | 3 |
| BACKGROUND CONTAMINATION | 4.5 | 4 | 3 | 2.5 |

IMAGE FORMING APPARATUS

BACKGROUND OF THE INVENTION

1. Field of the Invention

The present invention relates to an image forming apparatus and more particularly an image forming apparatus configured to obviate contamination ascribable to toner having a small grain size.

2. Description of the Background Art

A copier, printer, facsimile apparatus or similar electrophotographic image forming apparatus is conventional and includes an image carrier. A developer containing toner is used to develop a latent image formed on the image carrier for thereby producing a corresponding toner image. The toner image is transferred to a sheet or recording medium and then fixed thereon. A dry-process developing device, which uses a dry developer, develops the latent image by using any one of a cascade method, a magnet brush method, a powder cloud method and other conventional methods. The developer for the dry-process developing device is either one of toner only, i.e., a one-ingredient type developer and a toner and carrier mixture, i.e., a two-ingredient type developer.

It is a common practice with the developing device to stabilize image density by maintaining the toner content of the developer constant, i.e., by replenishing fresh toner at adequate timing. On the other hand, to promote the efficient use of limited resources, Japanese Patent Laid-Open Publication No. 60-41079, for example, proposes to collect toner left on an image carrier after image transfer and return it to the developing device. Japanese Patent Laid-Open Publication Nos. 6-175488 and 11-352761, for example, each disclose a particular toner recycling structure including a pipe extending from a cleaning device assigned to the image carrier to the developing device. A screw conveyor is disposed in the pipe for conveying the collected toner from the image carrier to the developing device.

On the other hand, lowering the melting point of toner is successful to promote rapid melting and infiltration of the toner during fixation and therefore to reduce fixing time. When toner with a low melting point is used, additives each may be coated on toner grains for a particular purpose, i.e., for preventing the fluidity of toner grains from being lowered or for increasing or reducing the amount of charge to deposit on the toner grains, as taught Japanese Patent Laid-Open Publication No. 6-175488 by way of example. The toner grains may additionally contain carnauba wax as a parting agent, as also taught in this document.

Today, the grain size of toner is sometimes reduced in order to enhance dot reproducibility and sharpness. For example, when the recycling system stated earlier is used and when operation speed is increased to reduce image forming time, use is made of toner with a small grain size in order to faithfully reproduce a dot image. More specifically, a smaller grain size makes dots less irregular in shape and thereby renders a halftone image more smooth. Further, for a given mean grain size, the greater the content of fine grains, the higher the dot reproducibility. However, some problems to be described later specifically are left unsolved when reproducibility is enhanced by use of toner with a small grain size and a great fine grain content.

Technologies relating to the present invention are also disclosed in, e.g., Japanese Patent Laid-Open Publication Nos. 2000-39740, 2000-172005, 2000-181128 and 2000-194161 and Japanese Patent No. 3,174,984.

SUMMARY OF THE INVENTION

It is an object of the present invention to provide an image forming apparatus capable of obviating, when use is made of toner with a small grain size, background contamination, toner scattering and sleeve contamination without regard to operation speed or environmental conditions.

In accordance with the present invention, in an image forming apparatus of the type developing a latent image formed on an image carrier, which moves at a linear velocity of 400 mm/sec or above, with a developer containing toner grains having a volume mean grain size of 5 $\mu$m to 10 $\mu$m and 60 number percent to 80 number percent of which has a grain size of 5 $\mu$m or below, the developer contains carrier grains having a weight mean grain size of 65 $\mu$m or below.

BRIEF DESCRIPTION OF THE DRAWINGS

The above and other objects, features and advantages of the present invention will become more apparent from the following detailed description taken with the accompanying drawings in which:

FIG. 8 is a table listing the results of experiments conducted to determine a relation between the characteristic of a developer (carrier grain size) applied to the illustrative embodiment and problems;

FIG. 9 is a table listing the results of experiments conducted to determine a relation between the characteristic of a developer (additive content) applied to the illustrative embodiment and problems.

DESCRIPTION OF THE PREFERRED EMBODIMENT

Figure 1:
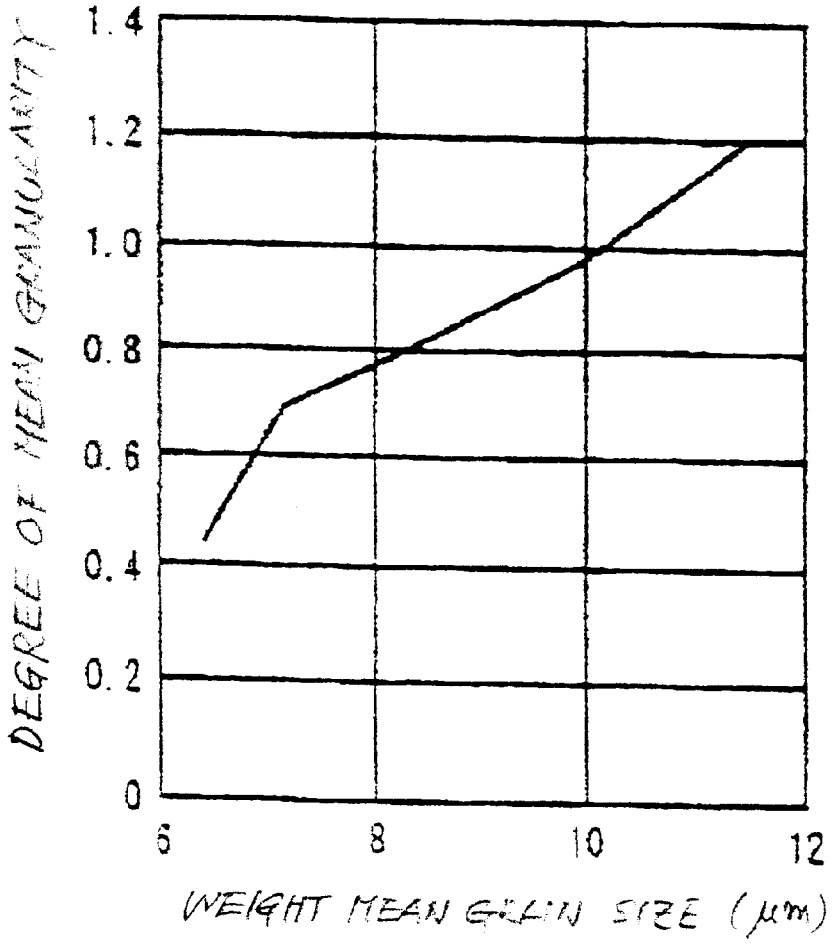
FIG. 1 is a graph showing a relation between the grain size of toner and dot reproducibility.

To better understand the present invention, the problems with the conventional technologies will be described more specifically hereinafter. Today, to meet the increasing demand for higher dot reproducibility and higher sharpness, the grain size of toner is decreasing, as stated earlier. FIG. 1 shows a relation between the weight mean grain size of toner and the degree of mean granularity. In FIG. 1, the smaller the mean granularity, the less the irregularity in dot shape and the more smooth a halftone image. As shown, the smoothness of a halftone image increases with a decrease in gain size. It will be seen that dot reproducibility increases with a decrease in the weight mean grain size of toner. More specifically, when the weight mean grain size is 10 $\mu$m or below, the mean granularity is 0.1 or below.

Figure 2:
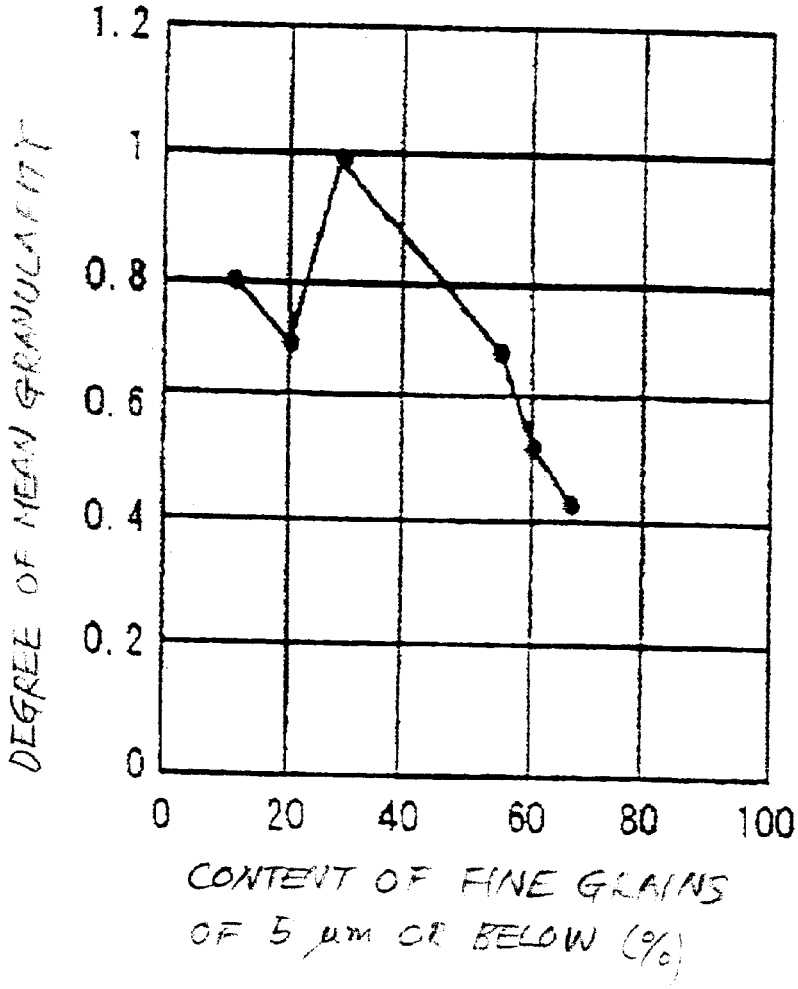
FIG. 2 is a graph showing a relation between the fine grain content of toner and dot reproducibility.

FIG. 2 indicates that for a given mean grain size, dot reproducibility increases with an increase in the content of fine grains. As shown, when the grain size is 5 μm to 10 μm, the mean granularity is as low as 0.6 or below for a fine grain content of 60 percent or above, so that desirable image density is achievable.

Figure 3:
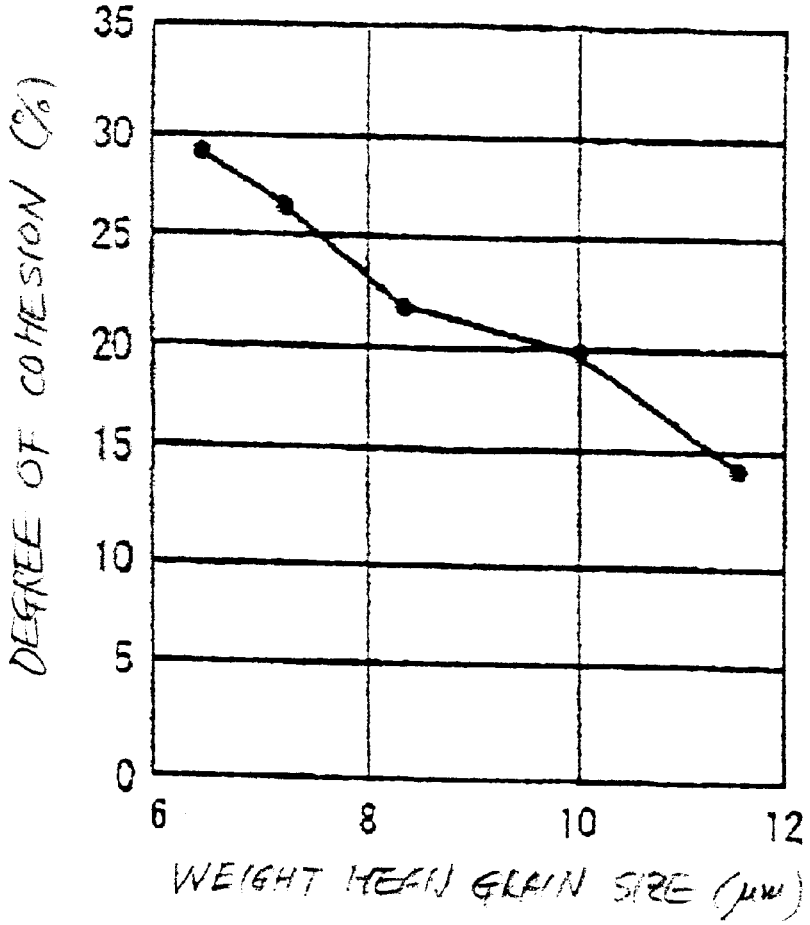
FIG. 3 is a graph showing the variation of the degree of cohesion determined with toner having a small grain size.
Figure 4:
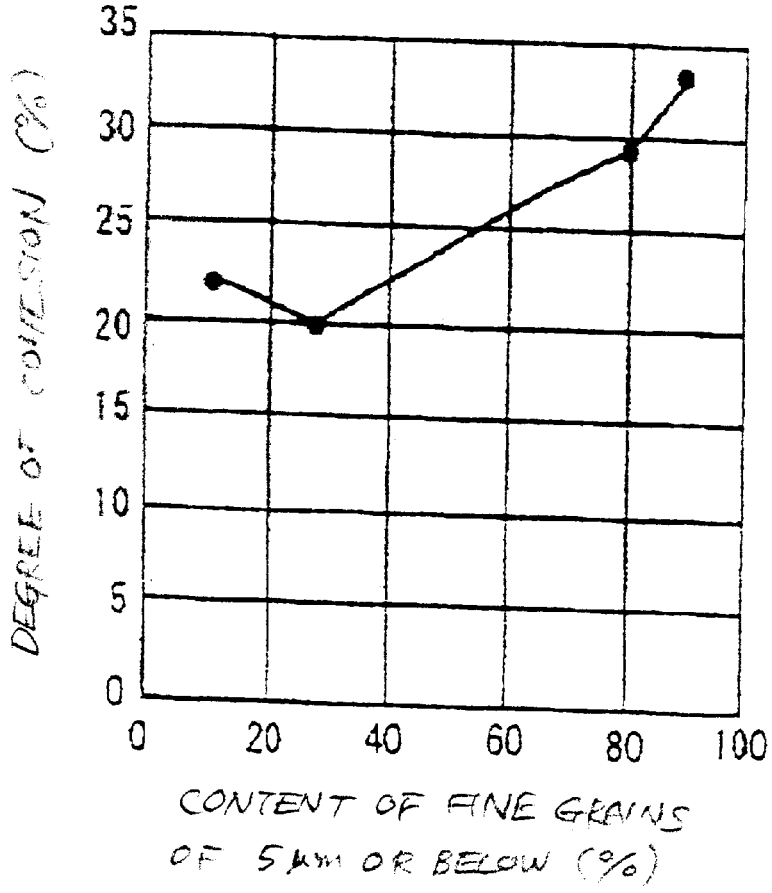
FIG. 4 is a graph showing a relation between the fine grain content of toner and the cohesion of toner.

However, a decrease in grain size and an increase in fine grain content directed toward low granularity bring about the following problems. As shown in FIGS. 3 and 4, it was experimentally found that the degree of cohesion of toner was aggravated due to a decrease in grain size. The degree of cohesion is represented by a ratio of toner left on a mesh of preselected size to the entire toner. An increase in the degree of cohesion not only aggravates conveyance, but also causes the masses of toner to effect images or deposit on and contaminate the background. As FIGS. 3 and 4 indicate, if the grain size of toner is between 5 μm and 10 μm, then the degree of cohesion can be reduced to 30 percent or below when the fine grain content is 60 percent or above.

Figure 5:
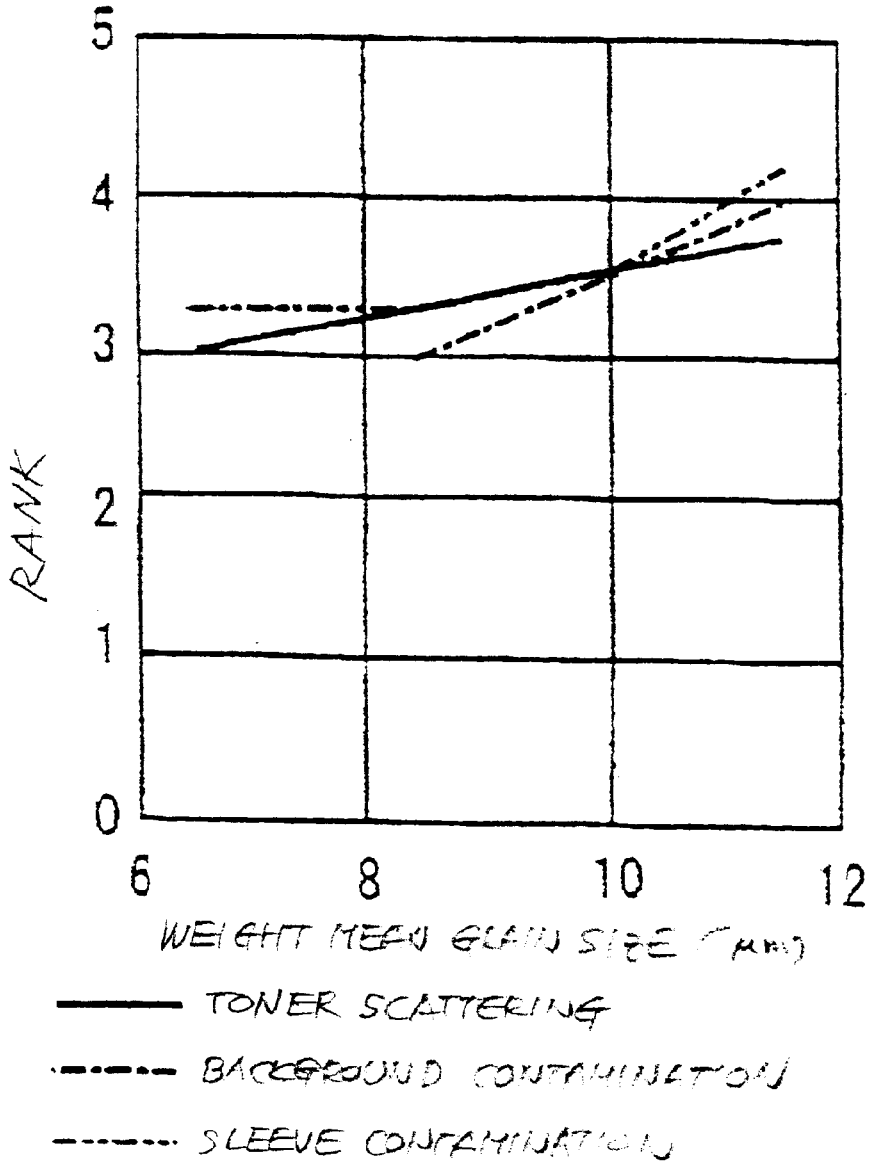
FIG. 5 is a graph demonstrating problems to occur when toner with a small grain size is used.

Particularly, when operation speed is increased, it is likely that the toner with a small grain size contaminates the background (background contamination), flies about (toner scattering, and contaminates a sleeve (sleeve contamination). FIG. 5 shows a relation between the weight mean grain size and the estimated rank as to the above problems; rank 5 is most desirable. Ranks 3.5 through 4 indicate allowable levels that implement desired image quality. The results shown in FIG. 5 were obtained with toner in which 10 number percent to 30 number percent of grains had grain sizes of 5 μm and below. When the fine grain content was 60 number percent or above, the rank was lower than 3.5 as to any one of the above problems.

Background contamination refers to the contamination of the background of an image carrier and is estimated by observing a toner image. Toner scattering refers to the leakage of toner from the casing of a developing device and is estimated by observing the seal portion of the casing, which is usually positioned at the upstream side in the direction of rotation of the image carrier. Sleeve contamination refers to the deposition of toner on a sleeve included in the developing device and is estimated by observing toner images after the formation of 10,000 toner images.

Figure 6:
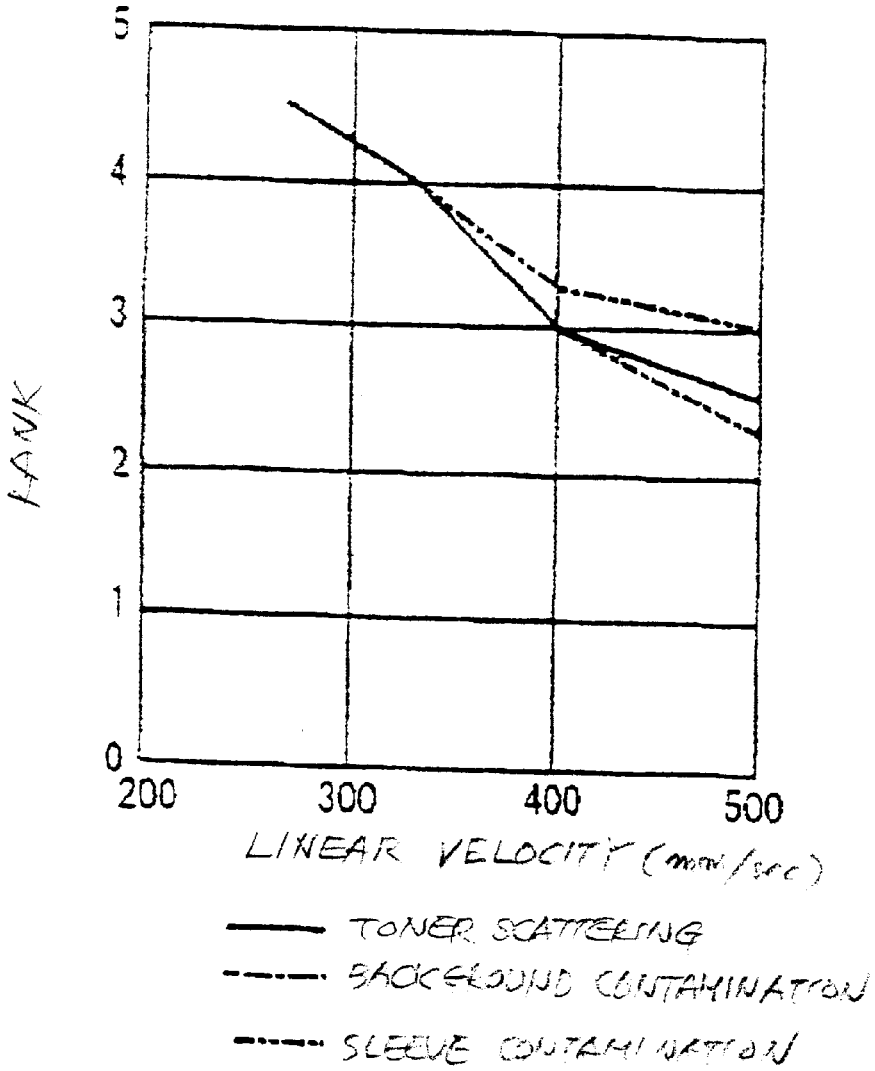
FIG. 6 is a graph showing a relation between linear velocity and the same problems.

As FIG. 5 indicates, the rank falls with a decrease in the mean grain size of toner. When the mean grain size is as small as 10 μm or below, the rank is below 3.5 due to the problems described above. The results shown in FIG. 5 were determined when the toner was recycled, when the carrier grain size was 80 μm, and when the toner had a mean grain size of 5 μm and a fine grain content of 10 number percent to 30 number percent. The problems discussed above become more serious when linear velocity is increased for high-speed operation. Specifically, as shown in FIG. 6, when linear velocity was increased above 400 mm/sec, the rank fell accordingly.

A series of researches and experiments were conducted to find the causes of the problems described above. As for background contamination, a decrease in grain size causes the charging characteristic of toner to vary. More specifically, if the grain size is simply reduced, then the amount of charge for a given weight of toner (Q/M) increases. Toner grains with high Q/M electrostatically, strongly adhere to the surfaces of carrier grains, obstructing the charging of fresh toner grains replenished to the developing device. As a result, toner grains with short charge exist in the developing device and fly about. Such toner grains are attracted by the background potential of the image carrier and contaminate the background. To reduce the toner grains flying about in the developing device, the entire grain size distribution may be made sharp, i.e., the difference in grain size may be reduced. However, when the fine grain content of the toner is increased to improve image quality, the amount of charge to deposit on the fine grains increases and concentratedly deposit on carrier grains. Stated another way, it is likely that grains other than such fine grains, i.e., coarse grains with low charge cannot deposit on carrier grains and fly about, again resulting in background contamination.

Although toner grains recycled to the developing device, i.e., recycled toner grains carry additives thereon, the additives are buried in the grains and cannot function as expected. The recycled toner grains are therefore short of fluidity and cannot be sufficiently scattered in the developing device during agitation, failing to rapidly reach the charge potential. When one of the additives has, e.g., a charging ability, the rise of the toner grains to the charge potential is further slowed down with the result that the toner grains are apt to miss the timing for electrostatic coupling with the carrier grains and contaminate the background. As the background contamination is aggravated, more toner is collected after image transfer and increases the ratio of the recycled toner grains to the entire developer, rendering background contamination conspicuous. In a low humidity environment, in particular, the amount of charge to deposit on the toner grains is apt to increase and cause the amount of charge of fine toner grains to further increase. This is likely to further slow down the rise of fresh toner grains to the charge potential for thereby making the background contamination more conspicuous.

As for toner scattering, a gap between the sleeve for development and part of the casing, which accommodates the sleeve, facing the sleeve is one of some different causes. Specifically, the height of a magnet brush formed on the sleeve has influence on the above gap. If the gap is excessively small, then the magnet brush hits against the above part of the casing. Conversely, if the gap is excessive large, then the sealing ability of such a part of the casing is impaired and causes the toner to leak due to pressure inside the developing device. Particularly, in a high-speed image forming apparatus, the image carrier in rotation generates an air stream and causes it to enter the developing device. The air stream entered the developing device raises the pressure inside the developing device, aggravating the leakage of the toner stated above. The leaked toner is scattered around in the image forming apparatus and contaminates the inside of the apparatus. This is particularly true when use is made of fine toner grains or toner with a great content of fine grains, which is light weight and easy to fly. Another cause of toner scattering is the slow rise of the toner to the charge potential stated earlier.

As for sleeve contamination, consideration should be given to the background potential of the image carrier and the charge potential of the toner. Specifically, the sleeve allows the toner to fly toward the image portion of the image carrier with a bias applied thereto. However, when the sleeve faces the background of the image carrier, the relation as to the direction of electric field is reversed with the result that the image carrier becomes a biasing portion and causes the toner to fly toward the sleeve. This phenomenon is particularly conspicuous when use is made of OPC (Organic Photoconductor) because the background of the photoconductor is charged to the same polarity as the toner, i.e., negative polarity. Consequently, the sleeve is contaminated not only by the non-electrostatic adhering force and the image force ascribable to the charge of the toner, but also by the reverse transfer of toner from the image carrier to the sleeve. Such reverse transfer of toner is likely to occur when the developing ability is high, e.g., when the toner content of the developer is great or when the sleeve is rotated at high speed, as determined by experiments.

Figure 7:
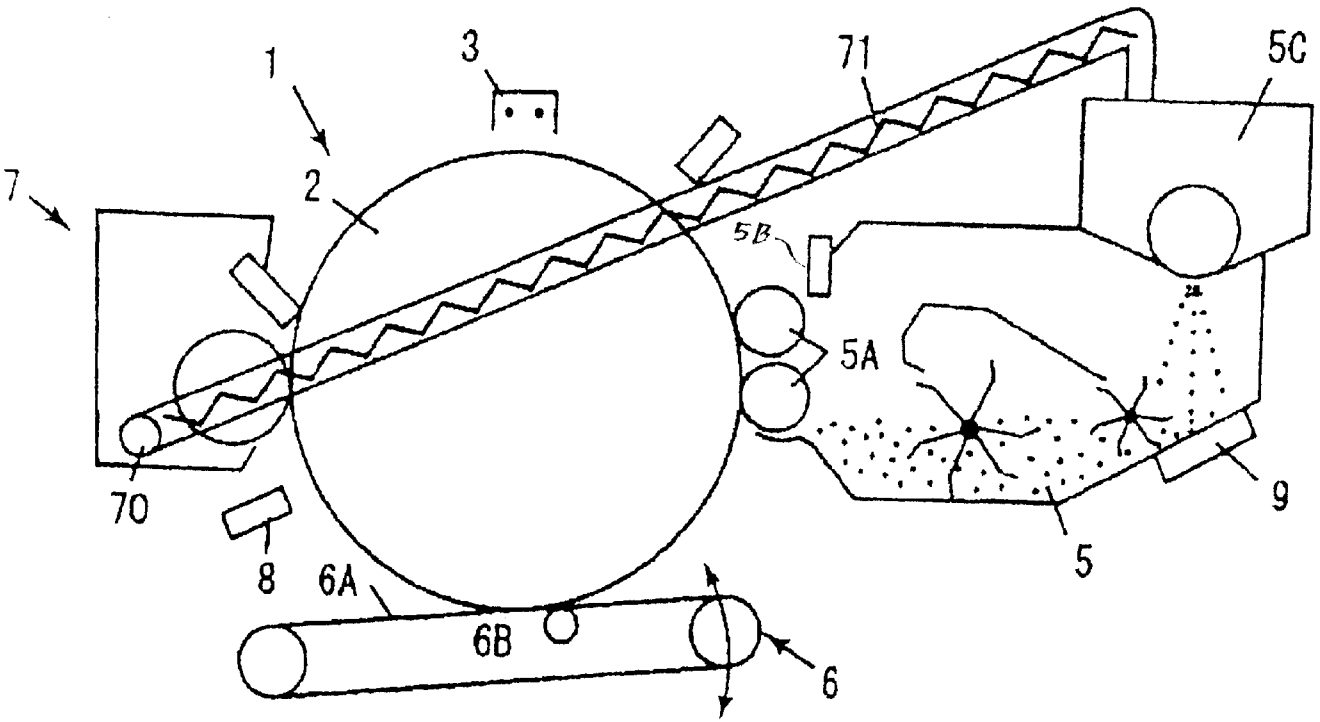
FIG. 7 is a view showing an image forming apparatus embodying the present invention.

Referring to FIG. 7, an image forming apparatus embodying the present invention is shown and generally designated by the reference numeral 1. The image forming apparatus 1 is implemented as a digital copier configured to scan a document laid on a glass platen by way of example. The present invention is, of course, applicable to any other image forming apparatus, e.g., a printer or a facsimile apparatus.

As shown in FIG. 7, the digital copier 1 includes a photoconductive drum 2, which is a specific form of an image carrier. Arranged around the drum 2 are a charger 3, a writing device 4, a developing device 5 including a sleeve 5A, an image transferring device 6, and a cleaning device 7 for executing a conventional image forming process. Specifically, while the drum 2 is in rotation, the charger 3 uniformly charges the surface of the drum 2. The writing device 4 scans the charged surface of the drum 2 with a light beam in accordance with image data to thereby form a latent image on the drum 2. The developing device 5 develops the latent image with toner for thereby producing a corresponding toner image. When a sheet fed from a sheet feeder, not shown, reaches the image transferring device 6, the image transferring device 6 transfers the toner image to the sheet. A fixing device, not shown, fixes the toner image on the sheet. After the image transfer, the cleaning device 7 removes the toner and charge left on the drum 2. Subsequently, the charger 3 again uniformly charges the surface of the drum 2 for thereby preparing it for the next image formation.

In the illustrative embodiment, the drum 2 is rotated at a linear velocity of 400 mm/sec while the linear velocity ratio of the sleeve 5A to the drum 2 is selected to be 2. More specifically, the sleeve 5A included in the developing device 5 is implemented as two sleeves or developing means 5A arranged side by side in the direction in which the drum 2 rotates. The two sleeves 5A can effect development in a plurality of steps despite the above high linear velocity, achieving a high developing ability.

The illustrative embodiment forms a latent image under the following conditions. While the photoconductor may be implemented by any one selenium (Se), OPC, amorphous silicon (s-Si) and so forth, the illustrative embodiment uses OPC. There are selected a potential (VL) of −100 V for a saturation density portion, a potential (VD) of −850 V for a white portion D, and a bias of −650 V for the development of an image portion. The bias for development is applied to the sleeves 5A from a power pack not shown. A gap Gp between the drum 2 and each sleeve 5A is 0.75 mm while a gap Gd between one sleeve 5A and a doctor blade 5B adjoining it is 0.6 mm. The doctor blade 5B regulates the developer deposited on the sleeve 5A such that it forms a thin layer on the sleeve 5A.

To control the toner content of the developer in accordance with image density, a reference toner image is intermittently formed on the drum 2 every time ten images are formed. The toner content is so corrected as to form the reference toner image. More specifically, the reference toner image is a patch image or P image formed by a P sensor potential. The P sensor potential is produced by subtracting the bias for forming the patch image (VB0) from the potential VL of the saturation density portion, i.e., VPP= VL−$VB_p$ (bias assigned to the reference toner image). The P sensor potential is selected to be −300 V.

An image density sensor 8 facing the drum 2 senses the density of the patch image formed on the drum 2, i.e., a reflection density value Vsp. The output of the image density sensor 8 is used to control the charging condition, bias for development, the quantity of light and other image forming conditions. In the illustrative embodiment, the image density sensor 8 senses the background potential Vsg at the beginning of one job corresponding to one image forming cycle, i.e., when toner is absent on the drum 2. Subsequently, the image density sensor 8 outputs a voltage Vsg representative of reflection density from the reference toner image and a voltage Vsg0 representative of reflection density from the background. A toner content sensor 9 has a target value Vref determined on the basis of the ratio of the voltage Vsg to the voltage Vsg0. A greater ratio Vsp/Vsg may be considered to represent a smaller toner content, so that the target value Vref is shifted in a greater amount to thereby rapidly control the image density to preselected one. The voltage Vsg0 has a reference value of 4 V while the voltage Vsp is controlled by using $\frac{1}{10}$*Vsg0 as a reference.

The toner content of the developer stored in the developing device 5 is controlled in accordance with the output of the toner content sensor 9. In the illustrative embodiment, the toner content sensor 9 senses a toner content in terms of the permeability Vt of the developer, which increases with a decrease in toner content. Toner replenishment is controlled in accordance with a difference between reference permeability and permeability actually sensed by the sensor 9. More specifically, if a difference Vref−Vt is smaller than or equal to zero, then fresh toner is replenished; the greater the absolute value of Vref−Vt, the greater the amount of toner replenished. If the difference Vref−Vt is greater than zero, meaning that the toner content of the developer is sufficiently high, no fresh toner is replenished. In the illustrative embodiment, an optimal toner content range of 5 weight percent to 3 weight percent is set up when the sensor output Vt is between 1.5 V and 3.5 V.

The image transferring device 6 includes an endless belt 6A selectively movable into or out of contact with the drum 2. The belt 6A conveys a sheet, not shown, while electrostatically retaining it thereon, so that a toner image is transferred from the drum 2 to the sheet. The image transferring device 6 additionally includes a bias roller 6B for image transfer.

The cleaning device 7 scrapes off the toner left on the drum 2 after image transfer and returns it to the developing device 5. For this purpose, the cleaning device 7 includes a screw 70 and a screw auger 71 disposed in a pipe, which is connected to a toner hopper 5C included in the developing device 5.

The developer for use in the developing device 5 will be described more specifically hereinafter. In the developing device 5 shown in FIG. 7, use is made of a two-ingredient type dry developer made up of toner grains and carrier grains. The toner grains have a volume mean grain size of 5 μm to 10 μm while 60 number percent to 80 number percent of the toner grains have a grain size of 5 μm or below. The carrier grains have a grain size of 65 μm or below.

The toner grains consist of resin and a colorant and may additionally include additives and a charge control agent coated on the grains. The toner grains have a volume mean grain size of 5 μm and 10 μm and a grain size distribution in which 60 number percent to 80 number percent of the grains have a grain size of 5 μm or below. Excessively large grain sizes would lower the resolution and dot reproducibility of images while excessively small grain sizes would lower the fluidity of toner. If the amount of the toner grains with the grain size of 5 μm or below is less than 60 number percent, then image quality cannot be improved for a given weight mean grain size. If the above amount is greater than 80 number percent, then the fluidity of toner is lowered. The grain size was measured by use of Coulter MULTISIZER IIe. The aperture diameter was 100 μm.

In the illustrative embodiment, 0.9 weight percent of silica and 0.4 weight percent of titanium oxide or above are coated on the toner grains as additives. The toner may be produced by either one of pulverization and polymerization.

All resins known in the art are applicable to the resin and include styrene, poly-α-stylstyrene, styrene-chlorostyrene copolymer, styrene-propylene copolymer, styrene-butadien copolymer, styrene-vinyl chloride copolymer, styrene-vinyl acetate copolymer, styrene-maleic acid copolymer, styrene-acrylate copolymer, styrene-methacrylate copolymer, styrene-α-chloromethyl acrylate, styrene-achrilonitrile-acrylate copolymer and other styrene resins (polymers or copolymers containing styrene or styrene substitutes), polyester resin, epoxy resin, vinyl chloride resin, rosin modified, maleic acid resin, phenol resin, polyethylene resin, ketone resin, ethylene-ethylacrylate copolymer, xylene resin, and polyvinyl butyrate resin. Two or more of such resins may be used in combination.

While the colorant is open to choice, use may be made of carbon black, Lamp Black, Iron Black, Ultramarine, Nigrosine Blue, Aniline Blue, Oil Black or Azooil Black by way of example. When the toner is used as a magnetic one-ingredient type developer, fine magnetic powder of iron oxide, magnetite or ferrite is added to the toner grains.

The additives coating the toner grains should preferably be inorganic grains having a primary gain size of 5 μm to 2 μm, particularly 5 μm to 500 μm, and a specific surface area of 20 $m^2/g$ to 500 $m^2/g$. The ratio of such inorganic fine grains to the toner grains should preferably be 0.1 weight percent to 5 weight percent, particularly 0.01 weight percent to 2.0 weight percent. Inorganic fine grains include silica, alumina, titanium oxide, barium titanate, magnesium titanate, calcium titanate, strontium titanate, zinc oxide, tin oxide, quartz sand, clay, mica, wallastonite, diatomaceous earth, chromium oxide, cerium oxide, Indian red, antimony trioxide, magnesium oxide, zirconium oxide, barium oxide, barium carbonate, calcium carbonate, silicon carbide, and silicon nitride. Other additives applicable to the illustrative embodiment include polystyrene, methacrylic acid ester and acrylic acid ester copolymer produced by soap-free emulsion polymerization, suspension polymerization or dispersion polymerization, silicone, benzoguanamine, nylon and other polycondensation products, and polymers of thermosetting resins.

The fluidizing agent or surface treating agent stated above enhances the hydrophobicity of the toner grains for thereby preventing the fluidity and charging characteristic from being degraded even in a humid environment. For example, use should preferably be made of a silane coupling agent, a silane coupling agent with an alkyl fluoride group, an organic titanate coupling agent or an aluminum coupling agent.

A parting agent for oilless fixation may be implemented by solid silicone vanish, montan-based ester wax, rice wax oxide or polypropylene was with a low molecular weight.

As for the charge control agent, use may be made of any one of conventional charge control agents including Nigrosine dyes, triphenylmethane dyes, chromium-containing metal complex dyes, chelate molybdate pigments, Rhodamine dyes, quaternary ammonium salts (including fluorine modified quaternary ammonium salts), alkylamide, phosphor and compounds thereof, tungsten and compounds thereof, fluorine-based active agents, salicylic acid metal salts, and metal salts of salicylic acid derivatives. Examples of the charge control agents are Bontrone 03 that is a Nigrosine dye, Bontrone P-51 that is a quaternary ammonium salt, Bontrone S-34 that is a metal containing azo dye, E-82 that is a metal complex based on oxynaphthoe acid, E-84 that is a metal complex based on salicylic acid and E-89 that is a condensate based on phenol (these are available from Orient chemical Industries, Ltd.) TP-302 and TP-415 that are quaternary ammonium salt molybdenum complexes (available from Hodogaya Chemical Industries, Ltd.), Copy Charge PSY VP2038 that is a quaternary ammonium salt, Copy Blue PR that is a triphenylmethane derivative, Copy Charge NEG VP2036 and NX VP434 that are quaternary ammonium salts (these are available from Hoext Japan), LRA-901 and LR-147 which is a boron complex (available from Japan Carlit Co., Ltd.), copper phthalocyanine, perylene, quinacridone, azo dyes, and high polymer compounds having a sulphonic acid group, a carboxyl group, a quaternary ammonium salt or similar functional group.

The toner applicable to the illustrative embodiment is produced by any conventional method. A specific method is mixing a binder resin, a wax component, a colorant and/or a charge control agent with a mixer, kneading the mixture with a heat roll, extruder or similar kneading machine, solidifying the kneaded mixture by cooling it, pulverizing the solidified mixture with a jet mill or similar machine, and then classifying the resulting powder.

For the carrier, use was made of magnetite powder having a weight mean grain size of 65 μm and coated with methacrylate resin (MMA; 0.5 μm thick). Such carrier grains were mixed with the previously stated toner grains with a toner content of 5.0 weight percent to thereby produce a developer. The core of the individual carrier grain may be implemented ferrite. The toner-carrier mixture ratio (TC) and the amount of charge (Q/M) of the developer were measured by a blow-off method. TC and QM were determined to be 3 weight percent to 5 weight percent and 40 μC/g to 50 μC/g, respectively.

As stated above, the illustrative embodiment uses carrier grains whose grain size is reduced in matching relation to the small grain size of toner grains. This increases the surface area of the individual carrier grain for a weight to thereby lower the covering ratio of the toner grains on the carrier grains, thereby improving the defective charging of the toner grains. Defective charging would cause the toner grains to fly about and deposit on the background or contaminate the inside of the apparatus.

FIGS. 8 and 9 show the results of ranking with respect to carrier grain size and additive condition. It will be seen that a decrease in the size of carrier grains and the addition of an additive noticeably reduce the defective charging of toner grains in combination.

Figure 10:
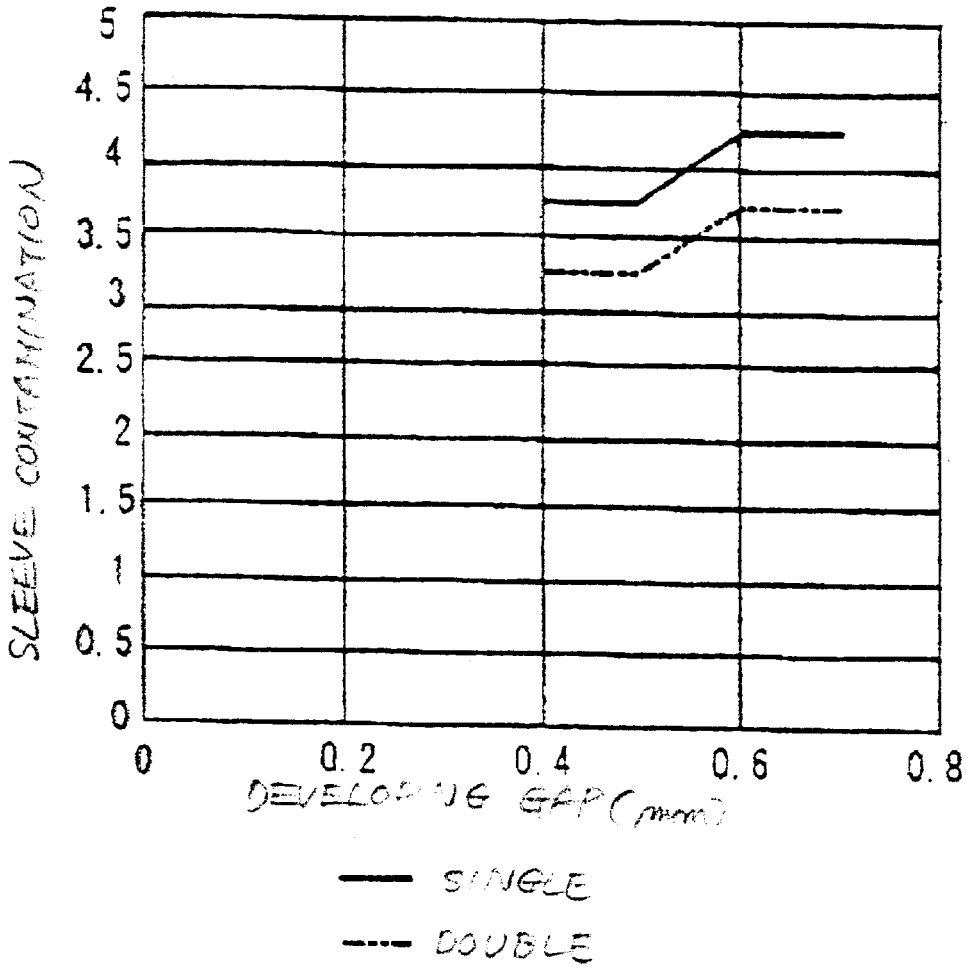
FIG. 10 is a graph demonstrating the advantage of the illustrative embodiment.

FIG. 10 shows the degree of contamination of the sleeve 5A. As shown, sleeve contamination decreases when a plurality of sleeves are used and when the gap for development is increased.

In summary, it will be seen that the present invention provides an image forming apparatus having various unprecedented advantages, as enumerated below.

(1) Use is made of carrier grains whose size is reduced in matching relation to the small size of toner grains. This increases the surface area of the individual carrier grain for a weight to thereby lower the covering ratio of the toner grains on the carrier grains, thereby improving the defective charging of the toner grains.

(2) Even when recycled toner grains whose fluidity is apt to decrease are used, toner grains are free from defective charging that would bring about background contamination, toner scattering and sleeve contamination.

(3) By increasing the amount of additives coating the toner grains, it is possible to enhance the fluidity of the toner grains and therefore to promote the scattering of the grains during agitation, thereby preventing the charge of the grains from remaining low. This reduces the amount of toner grains short of charge and therefore easy to fly and thereby obviates background contamination and toner scattering. Particularly, when silica with high chargeability is used alone, the amount of charge potential of the individual grain rises and is likely to bring about background contamination. The present invention solves such a problem by improving fluidity with titanium oxide for reducing the above charge. Background contamination and tone scattering therefore do not occur in, e.g., a low humidity environment.

(4) Even recycled toner grains with lowered fluidity can be fully scattered during agitation. In addition, the combination of silica and titanium surely obviates background contamination and toner scattering even in a low humidity environment.

(5) By setting an adequate gap between an image carrier and a developing device, it is possible to reduce the influence of an electric field that tends to cause the toner grains to fly from the image carrier to the developing device, thereby obviating sleeve contamination. This is particularly true when the above gap is large.

(6) When a plurality of developing means are used, the developing ability of each developing means and therefore the influence of the electric field can be reduced. This is also successful to efficiently prevent the flight of the toner grains from the image carrier toward the developing means for thereby obviating sleeve contamination.

Various modifications will become possible for those skilled in the art after receiving the teachings of the present disclosure without departing from the scope thereof.

What is claimed is:

1. In an image forming apparatus for developing a latent image formed on an image carrier, which moves at a linear velocity of 400 mm/sec or above, with a developer containing toner grains having a volume mean grain size of 5 $\mu$m to 10 $\mu$m and 60 number percent to 80 number percent of which has a grain size of 5 $\mu$m or below, said developer contains carrier grains having a weight mean grain size of 65 $\mu$m or below.

2. The apparatus as claimed in claim 1, wherein a developing device storing the developer includes a recycling structure for returning toner grains collected from said image carrier after image transfer to said developing device.

3. The apparatus as claimed in claim 2, wherein said image carrier and developing means included in said developing device are spaced from each other by a gap of 0.6 mm or above.

4. The apparatus as claimed in claim 3, wherein said developing means comprises a plurality of developing means arranged side by side in a direction in which said image carrier moves.

5. The apparatus as claimed in claim 1, wherein said image carrier and developing means included in said developing device are spaced from each other by a gap of 0.6 mm or above.

6. The apparatus as claimed in claim 5, wherein said developing means comprises a plurality of developing means arranged side by side in a direction in which said image carrier moves.

7. In an image forming apparatus for developing a latent image formed on an image carrier, which moves at a linear velocity of 400 mm/sec or above, with a developer containing toner grains having a volume mean grain size of 5 $\mu$m to 10 $\mu$m and 60 number percent to 80 number percent of which has a grain size of 5 $\mu$m or below, 0.9 weight percent of silica or above and 0.4 weight percent of titanium oxide or above are coated on said grains.

8. The apparatus as claimed in claim 7, wherein a developing device storing the developer includes a recycling structure for returning toner grains collected from said image carrier after image transfer to said developing device.

9. The apparatus as claimed in claim 8, wherein said image carrier and developing means included in said developing device are spaced from each other by a gap of 0.6 mm or above.

10. The apparatus as claimed in claim 9, wherein said developing means comprises a plurality of developing means arranged side by side in a direction in which said image carrier moves.

11. The apparatus as claimed in claim 7, wherein said image carrier and developing means included in said developing device are spaced from each other by a gap of 0.6 mm or above.

12. The apparatus as claimed in claim 11, wherein said developing means comprises a plurality of developing means arranged side by side in a direction in which said image carrier moves.

* * * * *